United States Patent [19]

Plumb

[11] Patent Number: 4,610,380

[45] Date of Patent: Sep. 9, 1986

[54] STAGGER FEEDER

[75] Inventor: Edwin W. Plumb, Woodbury, Conn.

[73] Assignee: Pressmate, Inc., Woodbury, Conn.

[21] Appl. No.: 665,041

[22] Filed: Oct. 26, 1984

[51] Int. Cl.[4] ..... B65H 20/00

[52] U.S. Cl. ..... 226/142; 226/162

[58] Field of Search ..... 226/115, 139–142, 226/158, 162, 166; 83/36, 216, 220, 234, 238, 249, 356, 356.2

[56] References Cited

U.S. PATENT DOCUMENTS

| | | | |
|---|---|---|---|
| 3,048,199 | 8/1962 | Barnes | 140/71 |
| 3,200,686 | 8/1965 | Norton et al. | 83/277 |
| 3,473,716 | 10/1969 | Butler | 226/142 |
| 3,880,034 | 4/1975 | Sapolsky | 83/220 |
| 4,051,987 | 10/1977 | Scribner | 226/115 |
| 4,144,783 | 3/1979 | Yamazaki et al. | 83/216 |
| 4,160,518 | 7/1979 | Scribner | 226/115 |
| 4,316,569 | 2/1982 | Gentile | 226/158 |

*Primary Examiner*—Leonard D. Christian
*Attorney, Agent, or Firm*—Hayes & Reinsmith

[57] ABSTRACT

A stagger feeder for a downstream machine such as a power press and the like is disclosed having a structure particularly suited to provide an actual linear path of movement of an activated feed head identical to the effective feed stroke of the material being moved by that feed head. Two movable feed heads are linked together mechanically, and the motion of these feed heads is controlled by a crank mechanism actuated by an indexing mechanism to trigger a pre-pressurized drive cylinder to effect feed stroking. Simplified adjustment of the effective length of the feed stroke is provided by the direct action stagger feeder of this invention to readily accommodate different size blanks in the downstream machine.

30 Claims, 14 Drawing Figures

STAGGER FEEDER

FIELD OF THE INVENTION

This invention generally relates to feeders for advancing strip stock to a downstream machine such as a power press and the like and specifically concerns high speed feeders of the type described.

BACKGROUND OF THE INVENTION

My copending U.S. patent application Ser. No. 660,143 entitled "Side By Side Air Feeder For Advancing Stock To A Power Press And The Like" filed Oct. 12, 1984 discloses an improved feeder which serves to impart motion to twin, side-by-side, linearly reciprocable feed slides featuring a mechanical crank mechanism associated with each feed slide. The crank mechanisms cooperate with a pair of power cylinders which are single acting in a stock advancing direction to respectively drive the feed slides and stock clamped thereby into an advanced stroke limit position during each feed stroke. That invention discloses a crank mechanism which serves both to effect harmonic deceleration of the feed slide, and its stock clamped thereby, to bring the same to a sudden non-destructive zero velocity halt in a precisely predetermined position established by a crank mechanism adjustment. Conventional requirements to utilize positive mechanical stops acting directly on the reciprocable feed slides are virtually eliminated, and different embodiments of drive means connected to the crank mechanism are disclosed in the referenced patent application to uniquely effect feed slide actuation.

However, previous unsolved problems remain in the provision of stagger feeder devices which differ from the feeder described. In stagger feeders, the desired path of the stock is at an angle relative to a so-called "Y" axis or overall feeding direction from the feeder to a downstream machine. Known prior art feeders achieve such desired movement (at an angle relative to the Y axis) generally as a result of discrete separate linear movements along the Y axis and also along a so-called "X" axis, which is perpendicular to the Y axis, to thereby effect a resulting angular displacement of the feed slide or "head". Other known feeders achieve the resultant effective angular displacement relative to the Y axis in a serpentine fashion depending on the nature of the actuating components linked to the feed head. The known devices achieving such stagger feeding are relatively complex, require buffering and mechanical stops and are relatively limited in speed to ensure non-destructive performance. Moreover, adjustment of the feed stroke length of such known stagger feed devices has been found to be particularly time consuming and frequently difficult to achieve with precision when strip stock of a different dimension for different size blanks is required to be fed by such stagger feeders to the downstream machine.

SUMMARY OF THE INVENTION

This invention concerns a feeder which is particularly suited to effect a so-called staggered pattern in the feeding of stock along a sawtooth path wherein each feed stroke of the feed heads is linear and disposed at an angle from the Y axis or general direction of feed and which uniquely features activated or clamping feed heads moving precisely along that staggered feed path of desired stock movement. Accordingly, this feeder effects a direct action feed which results in the actual path of each clamping feed head being identical to a desired effective feed stroke of the stock. Moreover, such direct action of the feed heads is not only accomplished by movements which are crank controlled but additionally exhibits the above noted advantages of my referenced copending patent application Ser. No. 660,143. This invention further features such direct action feed head movement with a significant concomitant advantage of vastly simplified adjustment of the length of the feed stroke wherein such adjustment is reduced to a single change in the relative positioning of one adjustable component of the crank mechanism without any requirements for backlash considerations or trial and error lead screw adjustments and the like commonly encountered in the known prior art.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

DESCRIPTION OF A PREFERRED EMBODIMENT

Figure 1:
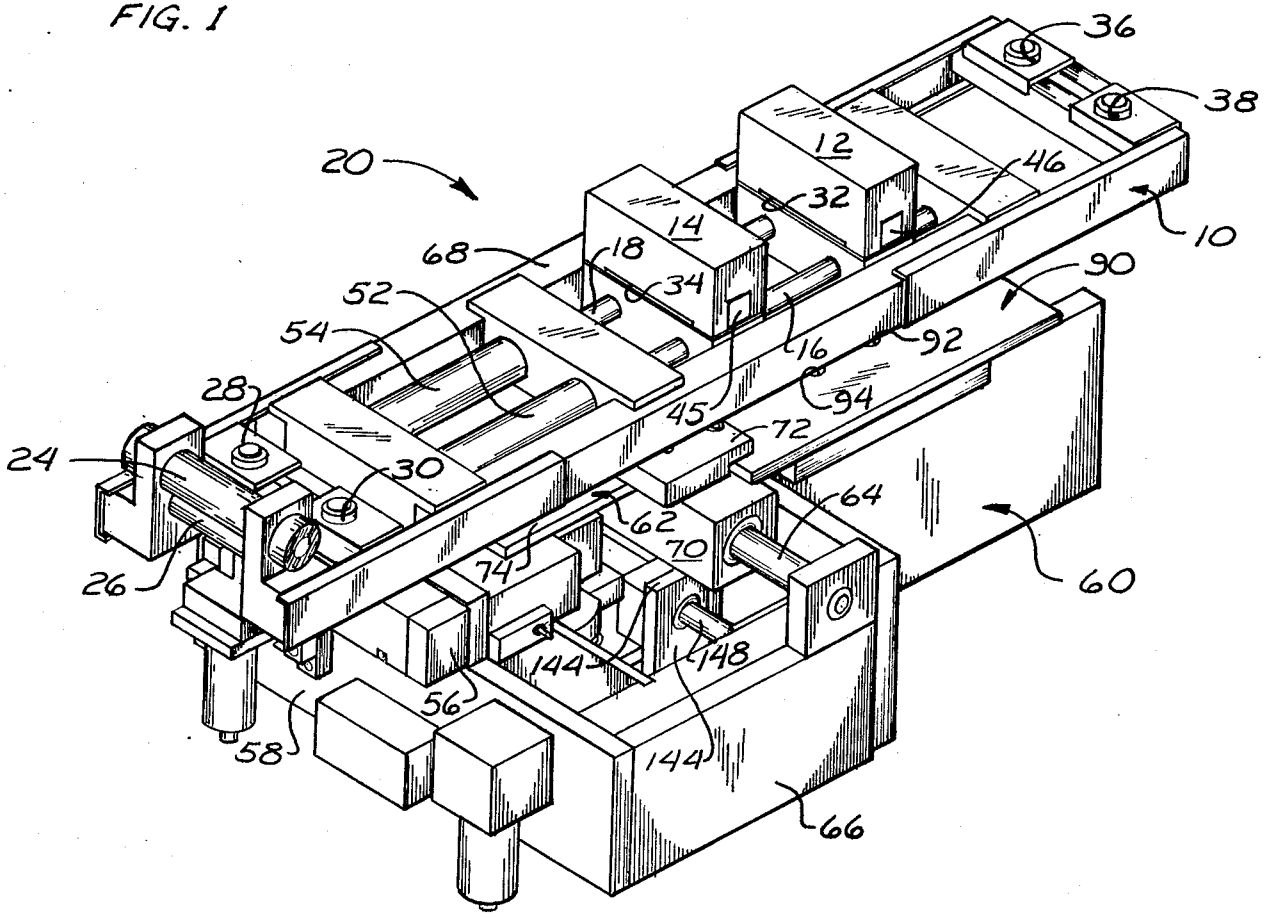
FIG. 1 is an isometric view showing a feeder incorporating this invention.
Figure 3:
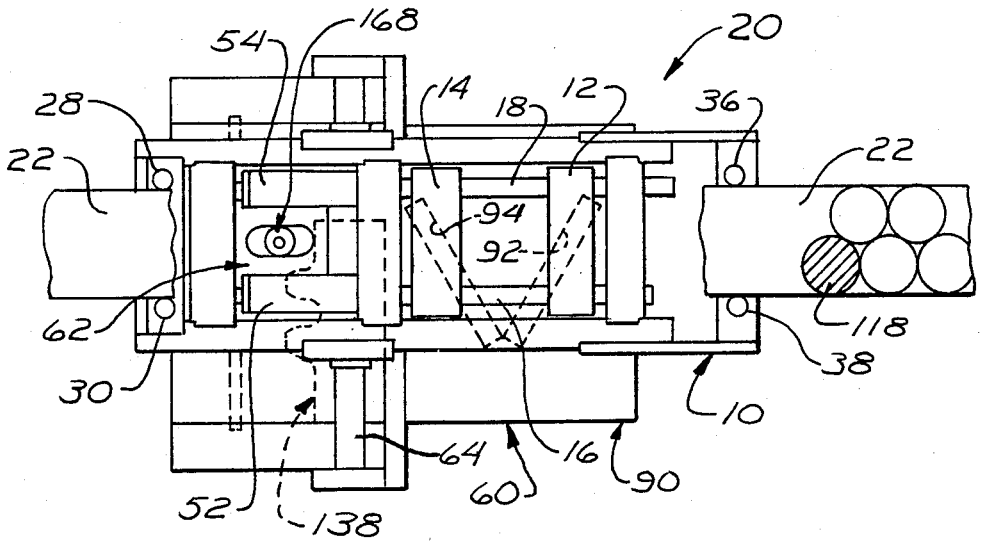
FIG. 3 is a plan view, similar to FIG. 2, schematically illustrating the feeder in a second punching position.

Referring now to the drawings in detail, a generally rectangular carriage 10 is shown in FIG. 1 having a pair of feed slides or feed heads 12, 14 slidably supported on guide rods 16, 18 defining a Y axis extending in a general feeding direction to the right as viewed in FIGS. 1–4 to a downstream machine, not shown, such as a power press and the like to which feeder 20 of this invention intermittently advances strip material such as illustrated stock 22 (FIGS. 2 and 3) which is formed of a suitable material such as metal. Feeder 20 includes a pair of rollers 24, 26 mounted at an input end of carriage 10 through which strip stock 22 passes, and a pair of adjustable lateral guide rollers 28, 30. Suitable slots such as at 32 and 34 are provided in feed heads 12 and 14 through which the stock 22 passes prior to being received between a pair of downstream adjustable lateral guide rollers 36, 38 at an output end of carriage 10 which is just upstream of the machine to which the strip stock 22 is to be fed.

Figure 4:
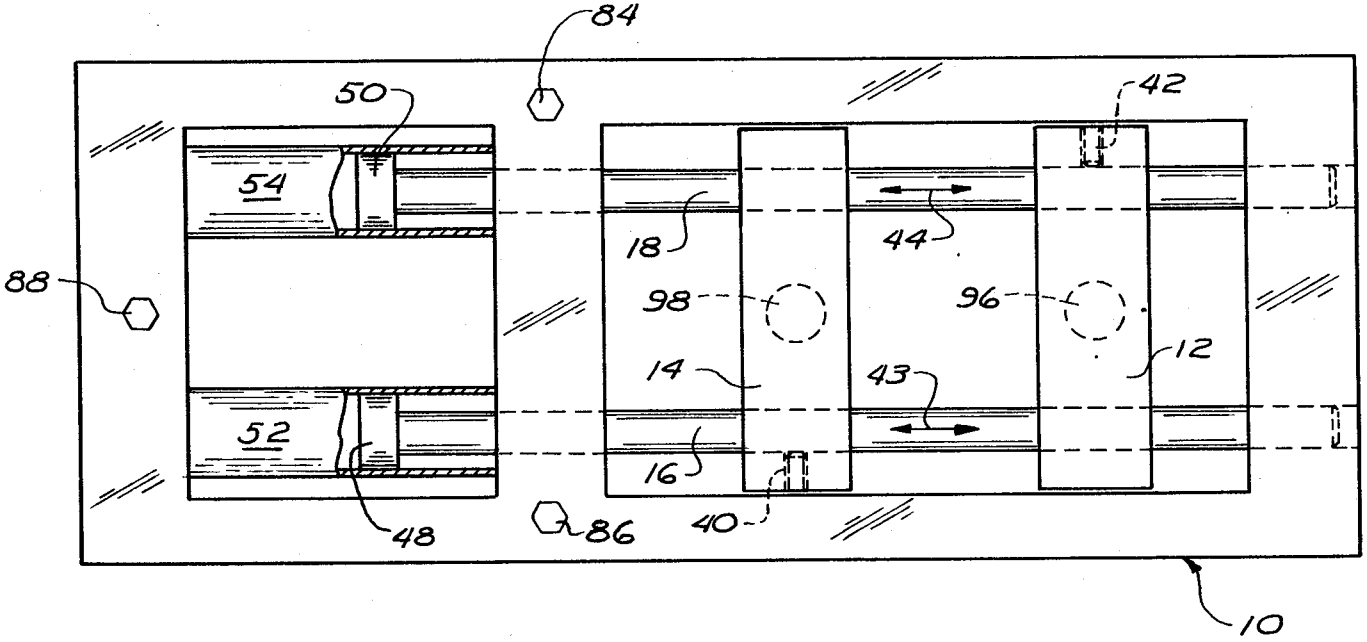
FIG. 4 is a plan view, partly broken away and partly in section, showing a carriage of the feeder of FIG. 1 and a pair of feed heads supported by that carriage.

Referring now to FIG. 4, feed head 14 is secured to guide rod 16 by a suitable fastener, such as illustrated set screw 40, and slides on guide rod 18 which is in spaced parallel relation to guide rod 16. Feed head 12 is attached by set screw 42 to guide rod 18 and is slidable on guide rod 16. Each of the guide rods 16, 18 are in turn mounted for reciprocable sliding movement in the directions of arrows 43, 44 in carriage 10 and accordingly confine feed heads 12, 14 to straight line guided paths parallel to the Y axis and relative to carriage 10. Each feed head 12, 14, includes an air powered clamping means generally depicted at 45, 46 (FIG. 1) to selectively grip stock 22 when feeding generally along the Y axis and to release that stock 22 when the respective feed head is returning in the opposite direction.

Terminal ends of guide rods 16, 18 include pistons 48, 50 received for linear reciprocable movement within single acting drive cylinders 52, 54. When feed head 14 is to move in the feeding direction (to the right as viewed in the drawings), air is admitted to cylinder 52 through a suitable line of a fluid circuit, not shown, which will be understood to be connected to a conventional source of compressed air and controlled by a four-way valve 56 mounted on an end wall 58 of underlying frame 60 of feeder 20 adjacent the input end of carriage 10. Pressurized air serves as a main driving force powering the feeding action. In addition to pressurizing drive cylinder 52, the compressed air also passes from cylinder 52 through an opening, not shown, within guide rod 16 which opening is connected to a clamping cylinder of clamping means 45 in feed head 14, simultaneously causing feed head 14 to activate and grip stock 22 which is to be fed to the downstream machine. An identical arrangement will be understood to be incorporated in the structure for feed head 12, guide rod 18, its drive cylinder 54 and clamping means 46.

Figure 5:
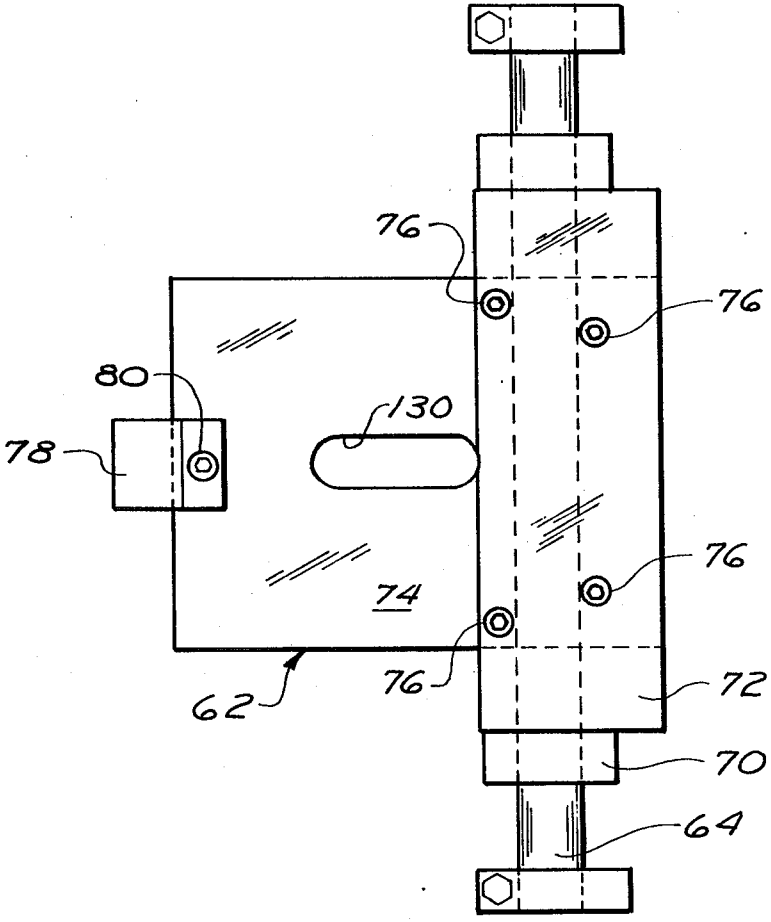
FIG. 5 is a plan view showing a drive plate assembly incorporated in the feeder of FIG. 1.

Fixed to carriage 10 is a drive plate assembly 62 (FIG. 5) which is mounted in underlying relation to carriage 10. Drive plate assembly 62 includes a laterally extending guide rod 64 fixed to opposite side walls 66, 68 of feeder frame 60 to extend laterally across feeder 20. A slide block 70 is mounted on guide rod 64 for linear sliding reciprocation parallel to an "X" axis perpendicular to the general feeding direction or Y axis. A spacer plate 72 is mounted in overlying relation to a drive plate 74 and slide block 70, with the drive plate 74 extending rearwardly of guide rod 64.

Figure 6:
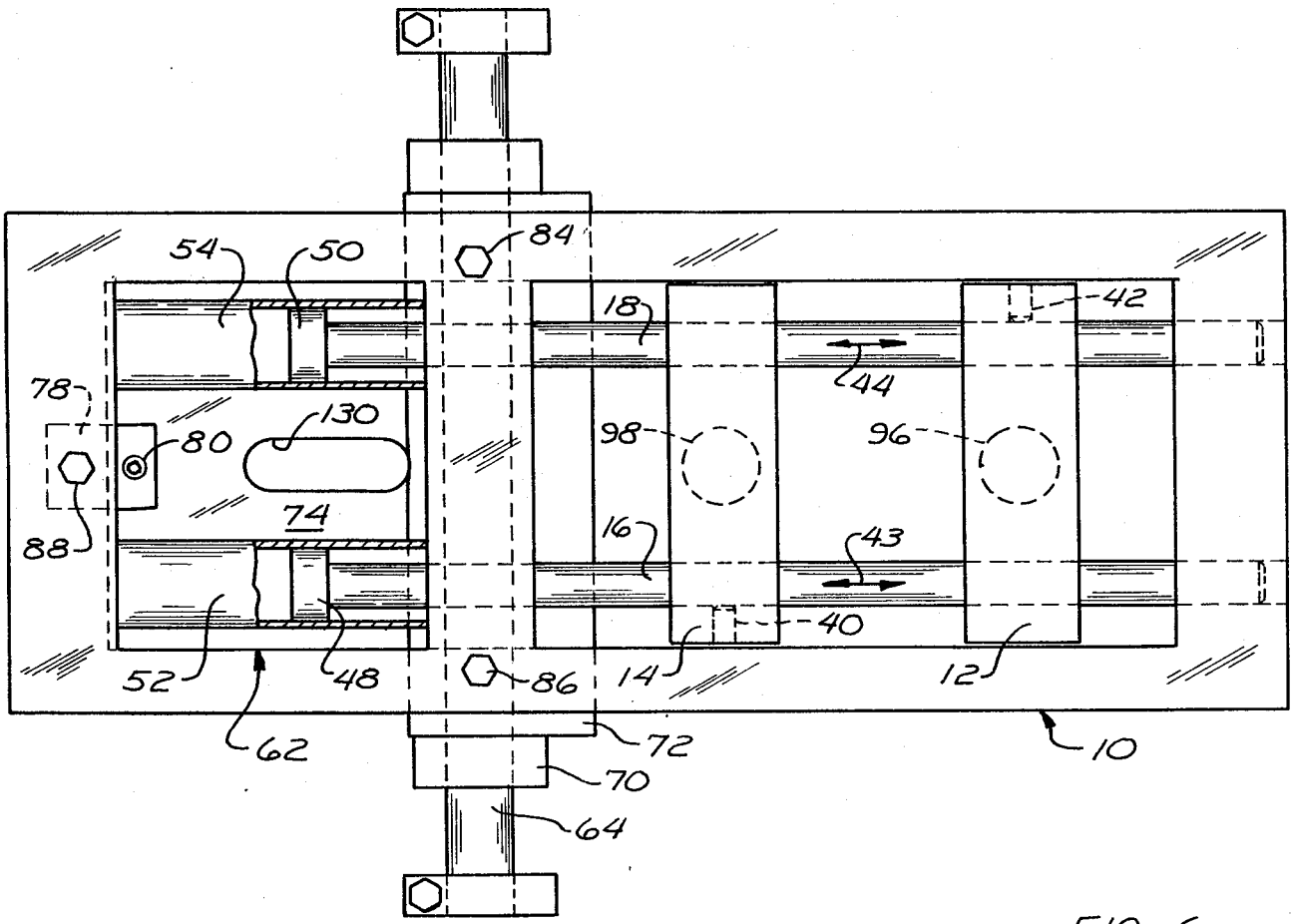
FIG. 6 is a plan view, partly broken away and partly in section, showing the feeder components of FIGS. 4 and 5 in assembled relation.

To fix these components in a unitary assembly, screws such as at 76 are provided to secure spacer plate 72 and drive plate 74 in fixed relation to slide block 70, whereby the entire drive plate assembly 62 is limited to movement along a straight line guided path established by guide rod 64 parallel to the X axis. An end block 78 is shown fastened by screw 80 to an end of drive plate 74. As best seen in FIG. 6, carriage 10 and drive plate assembly 62 are assembled in operative association, and a pair of hex bolts 84, 86 fix carriage 10 to drive plate assembly 62. A third hex bolt 88 secures carriage 10 to end block 78. Such construction accordingly constrains carriage 10 to a straight line guided path parallel to the X axis.

Figure 7:
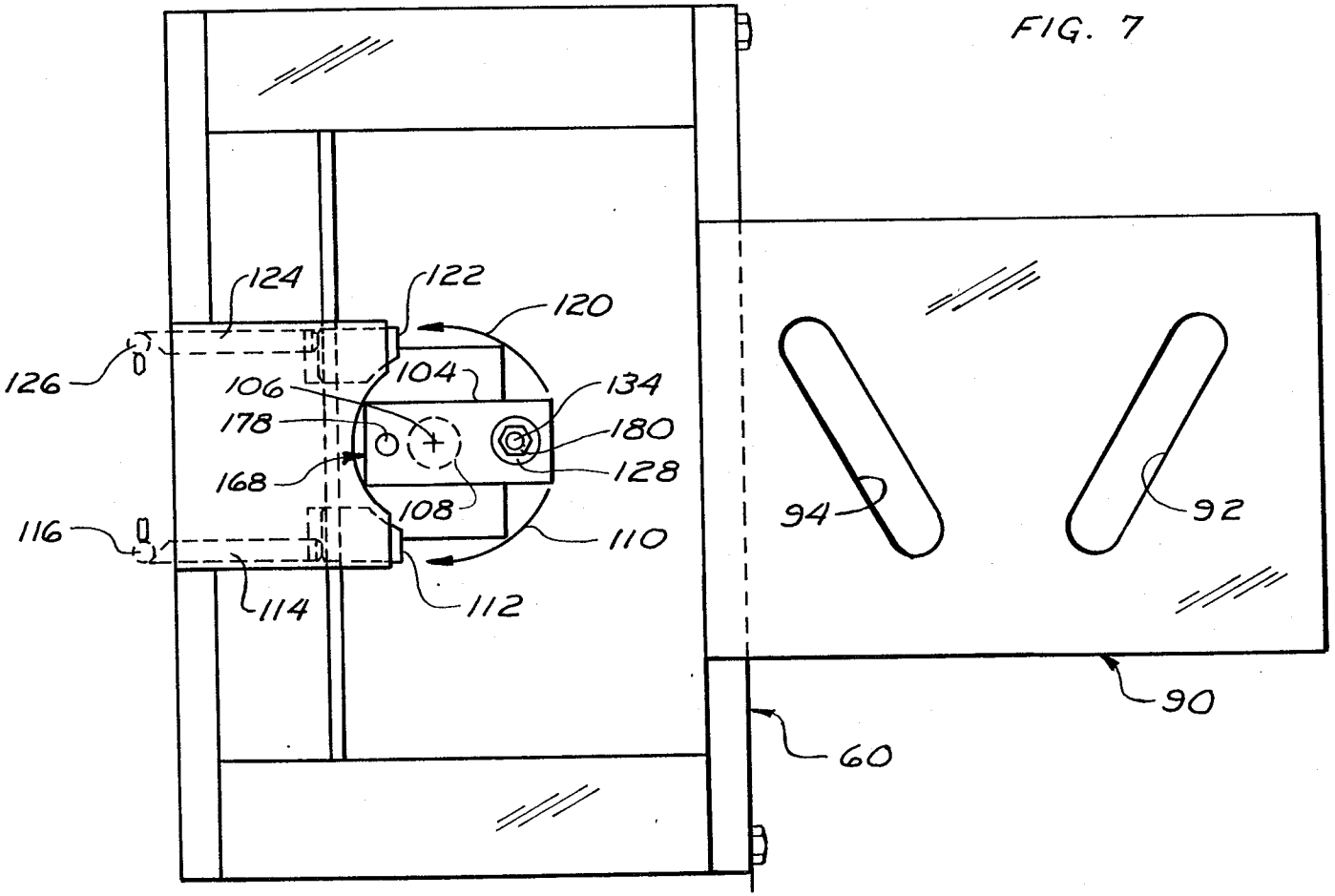
FIG. 7 is a plan view, partly broken away and partly in section, illustrating a head of a crank mechanism for controlling movement of the drive plate assembly and associated carriage of FIGS. 4 and 5.

Turning now to FIG. 7, a stationary guide plate 90 is shown which is fixed to feeder frame 60 (FIG. 1) in underlying relation to carriage 10. With carriage 10 limited to reciprocable movement along guide rod 64 parallel to the X axis and feed heads 12, 14 restrained to reciprocable movement along guide rods 16, 18 which extend parallel to the Y axis, a unique direct action feed head movement is provided for the stagger feeder 20 in accordance with this invention. Feeder 20 features an active clamping feed head 12, 14 moving along the actual desired linear path of movement of the stock 22 being advanced by that activated feed head to the downstream machine by the above described construction coupled with the provision of angularly disposed guide slots 92, 94 formed in guide plate 90 for controlling feed head movement.

More specifically, guide slots 92 and 94 are shown formed in guide plate 90 at opposed angles of 30° from the X axis and are dimensioned and configured for receiving rollers 96 and 98 (FIGS. 4 and 9) which depend from feed heads 12, 14. Such construction serves to provide a cam and cam follower connection between feed heads 12, 14 and frame 60 and insures that feed heads 12, 14 are restrained to move only along paths displaced at a selected angle from the X axis which in the preferred embodiment is shown as being a 30° angle. As feed heads 12, 14 move along such opposed angular paths relative to the X axis, those feed heads 12, 14 also move relative to carriage 10, on which they are slidably mounted, at opposed 60° angles relative to the Y axis. It will be understood that while the particular angular orientation of slots 92, 94 is correct for punching round blanks in stock 22 by the downstream machine, other blank shapes will require possibly other angular orientation. Slots 92, 94 in guide plate 90 and the connecting rollers 96, 98 serve as mechanical links for the two moving feed heads 12, 14 so that as one feed head moves forwardly to feed stock 22, such as feed head 14 (FIG. 2), the other (such as feed head 12) moves rearwardly on an idle return stroke.

Figure 2:
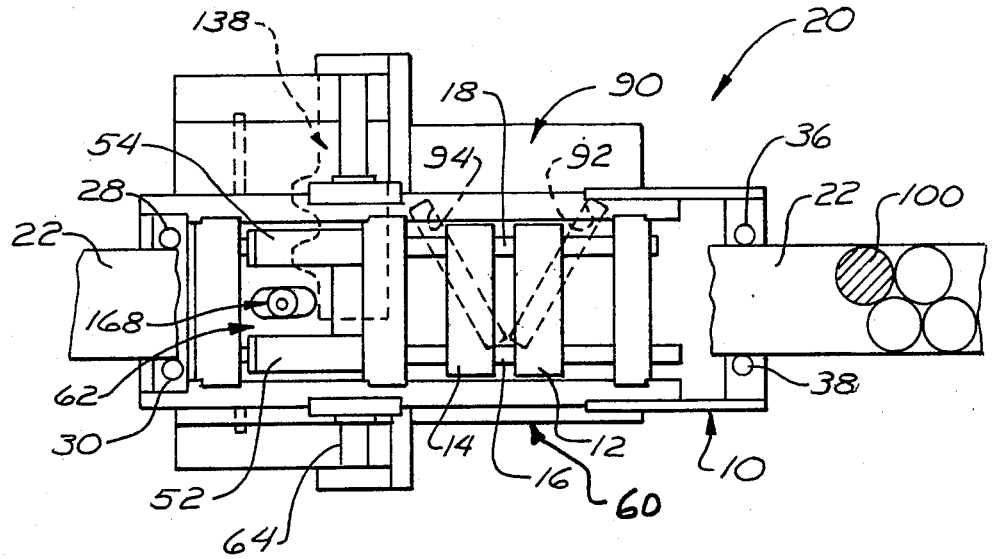
FIG. 2 is a plan view, on a reduced scale, schematically illustrating the feeder of FIG. 1 in a first punching position.

In the two row stagger feeder of this embodiment, when carriage 10 reciprocates parallel to the X axis, feed heads 12, 14 simultaneously diverge in one direction of carriage movement parallel to the X axis and converge in unison in the opposite direction of carriage movement. Such action also causes feed heads 12, 14 to simultaneously move relative to carriage 10 in opposite directions parallel to the Y axis. As illustrated in FIG. 2, activated feed head 14 has just moved stock 22 to a first illustrated stationary punching position wherein a round blank (shaded at 100 in FIG. 2) is in position to be formed in stock 22 by the downstream machine. At this time, drive cylinder pressurization is switched to exhaust drive cylinder 52 and clamping means 45 for feed head 14 and to pressurize drive cylinder 54 and clamping means 46 for feed head 12, in preparation for the next feed stroke. That next stroke is prevented from taking place, however, until a signal has been received from the downstream machine.

To control motion of the two movable feed heads 12, 14, an indexing actuator is provided for simultaneously releasing carriage 10 for movement and triggering actuation of feed heads 12, 14. This actuator includes both an indexing mechanism 102 and crank mechanism 168. Indexing mechanism 102 is provided to index a crank mechanism 168 which actuates the drive plate assembly 62 and also controls the drive cylinders 52, 54 for operating feed heads 12, 14. The actuating control for fluid connections to the drive cylinders 52, 54 and clamps 45, 46 of feed heads 14, 12 is seen in FIG. 7. The machine actuated indexing mechanism 102 (FIG. 13) operates crank head 104 of crank mechanism 168 which oscillates 180° about pivot axis or center 106 of its drive shaft 108 (FIG. 7). In the drawings, crank head 104 is illustrated at mid point, a position it assumes only momentarily once each feed stroke.

As feed heads 12, 14 converge into the first stroke limit or punching position illustrated in FIG. 2, crank head 104 moves in the direction of arrow 110 (FIGS. 7–9) in a clockwise direction into contact with buffer 112 which moves to the left, as viewed in the drawings, to displace rod 114 to the left. Rod 114 has an angular surface at its end in contact with ball 116 which, upon being shifted, in turn will be understood to actuate four-way valve 56 (FIG. 1). This action causes drive cylinder 52 to exhaust, thereby conditioning feed head 14 for an idle return stroke and at the same time releasing its clamping means 45. Simultaneously, drive cylinder 54 is pressurized, conditioning feed head 12 for the next feed stroke and also pressurizing its clamping means 46 to grip stock 22 for a subsequent forward movement wherein feed heads 12, 14 diverge from the first punching position (FIG. 2) with feed head 12 driving stock 22 into its second punching position (FIG. 3) to locate the shaded area illustrated at 118 in position to be formed into a blank. When crank head 104 moves counterclockwise in the direction of arrow 120 (FIGS. 7–9), drive cylinder 54 is permitted to operate, as fully described below, and upon crank head 104 traveling 180°, it contacts buffer 122 which displaces rod 124 to move to the left (as viewed the drawings) and which, through ball 126, shifts four-way valve 56 to its opposite position to reverse the supply and exhaust connections to drive cylinders 52, 54 and clamping means 45, 46 of their respective feed heads 14, 12.

Figure 8:
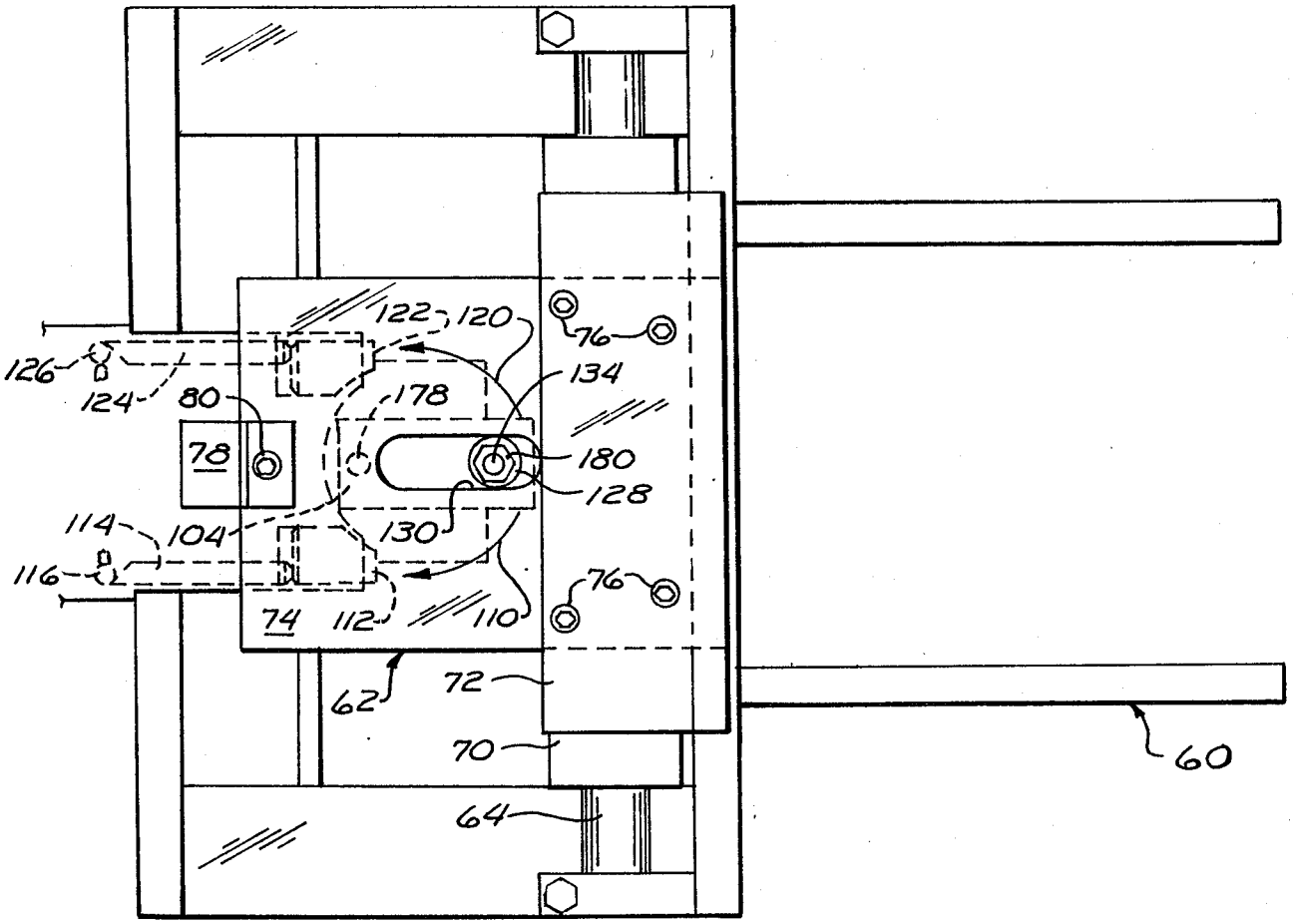
FIG. 8 is a plan view showing the drive plate assembly of FIG. 5 in assembly with the head of the crank mechanism of FIG. 7.
Figure 9:
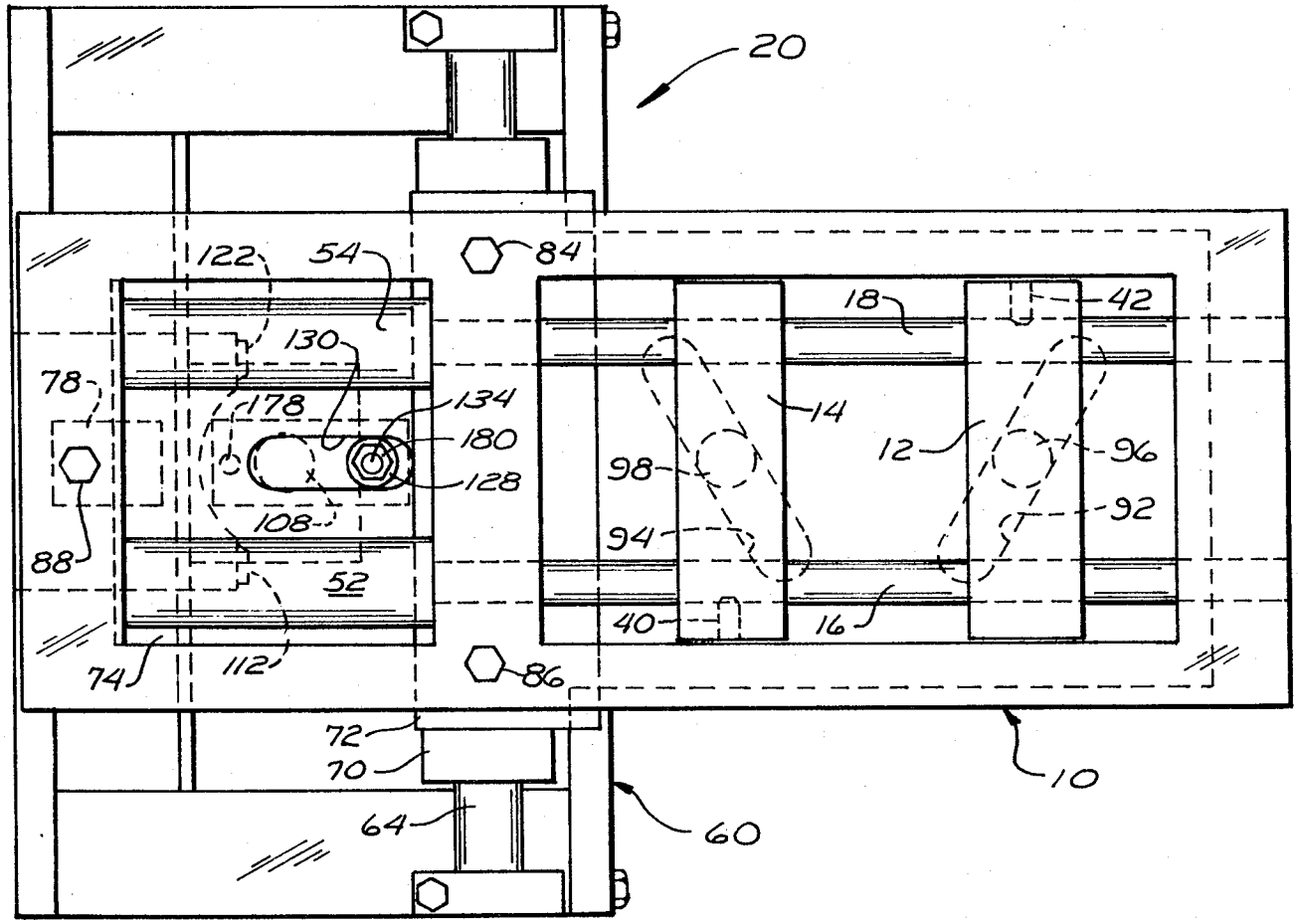
FIG. 9 is a plan view, partly broken away and partly in section, illustrating the components of FIG. 8 in assembly with the carriage of FIG. 4.
Figure 10:
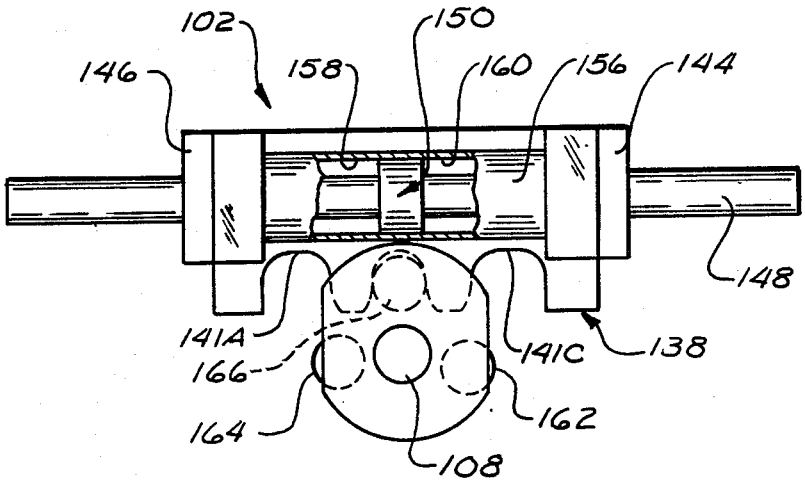
FIG. 10 is a plan view, partly broken away and partly in section, showing certain components of an indexing mechanism for the crank mechanism of FIG. 7.
Figure 11:
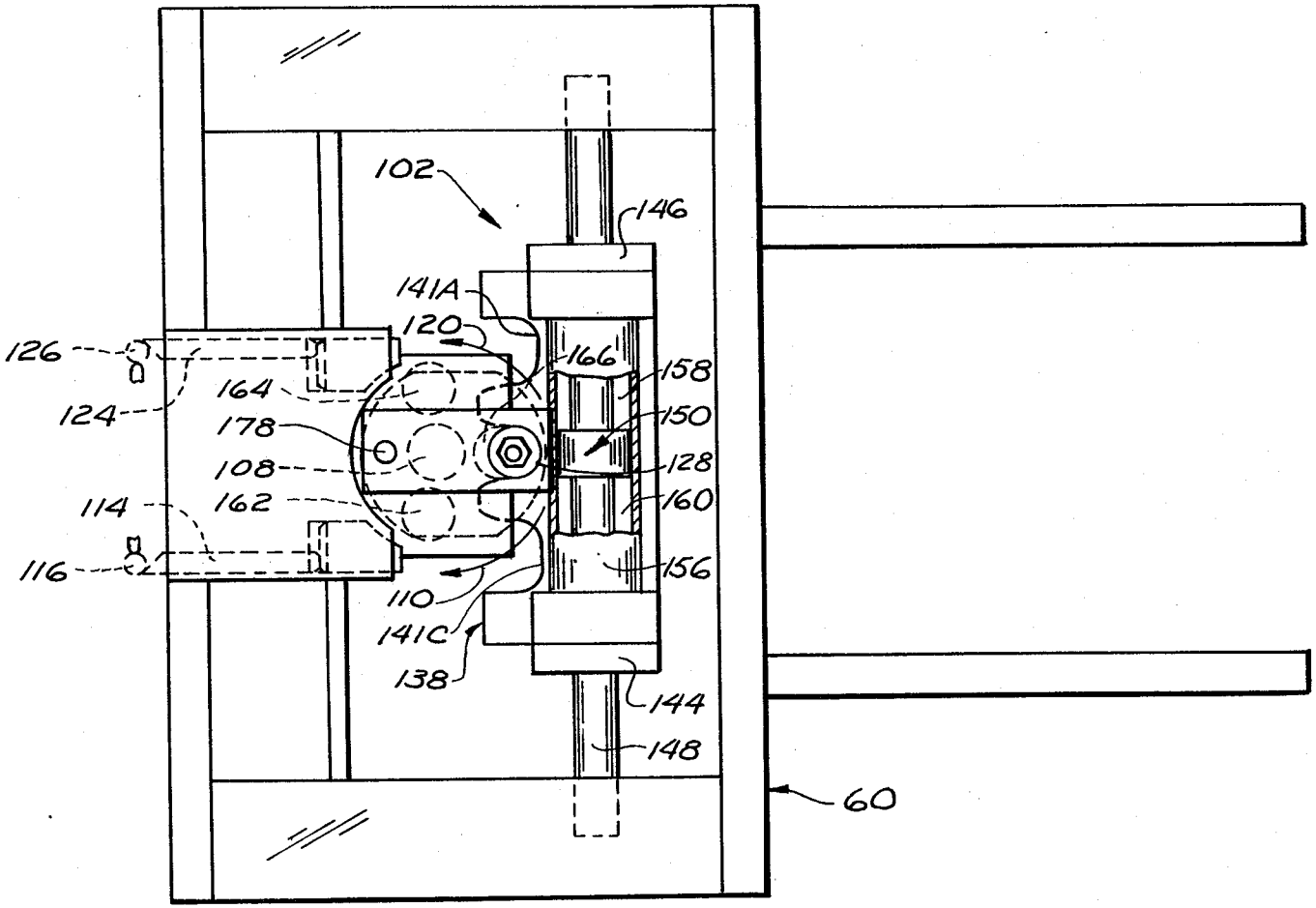
FIG. 11 is a plan view, partly broken away and partly in section, showing the indexing mechanism of FIG. 10 in assembly with the crank mechanism of FIG. 7.
Figure 13:
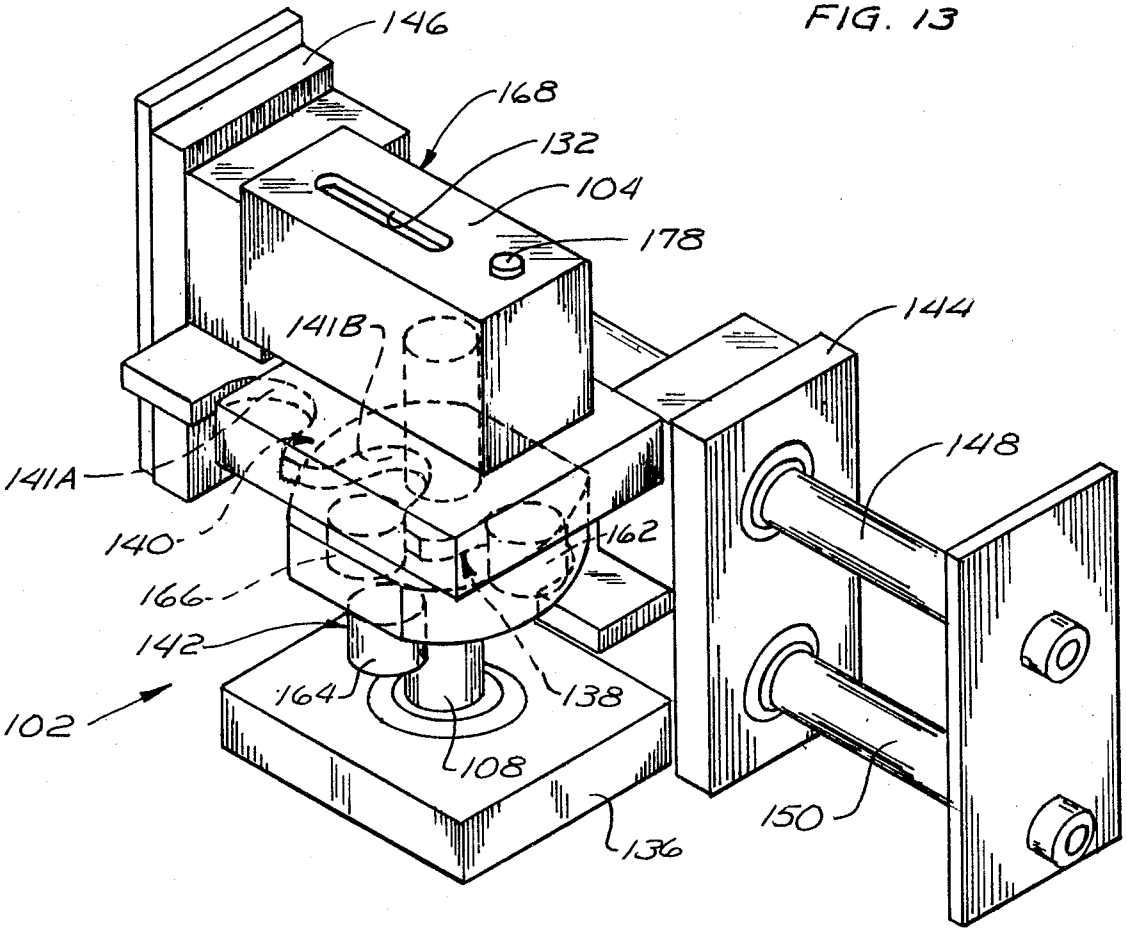
FIG. 13 is an isometric view of the indexing mechanism of FIG. 10 in assembly with the associated crank mechanism of FIG. 7.

To index the carriage 10 and thereby trigger feed head actuation as described above responsive to a prepressurized drive cylinder, a roller 128 projecting upwardly from crank head 104 is received within a central slot 130 in drive plate 74 (FIGS. 8 and 9). Slot 130 extends in parallel relation to the Y axis. As best seen in FIG. 13, crank head 104 is shown as a generally rectangular block having a longitudinally extending slot 132 within which a bolt 134 (FIGS. 7–9) is located for mounting roller 128. Bolt 134 may be adjustably located in eccentric relation to the center 106 of drive shaft 108 to selectively establish the throw of crank head 104.

As crank head 104 oscillates 180° from one extreme limit position to the other, roller 128, which engages slot 130 in drive plate 74, permits that drive plate 74 to advance carriage 10 and reciprocate parallel to the X axis along guide rod 64. As will be understood, crank head 104 is shown in the drawings in midstroke, a position that it assumes only momentarily once each stroke. The normal "at rest" positions of crank head 104 are 90° in opposite angular directions from its illustrated midstroke position.

When crank head 104 is angularly displaced 90° clockwise from its midstroke position illustrated in FIGS. 8 and 9, carriage 10 is displaced downwardly as viewed in the drawings into the first punching position illustrated in FIG. 2, and compressed air is supplied to drive cylinder 54 urging the clamped feed head 12 forwardly, but feed head 12 cannot move forwardly because feed head 14 is constrained to a rearwardly directed path 30° relative to the X axis. For feed head 12 to move forwardly, carriage 10 must move upwardly (as viewed in FIGS. 2 and 3) but cannot do so, because roller 128 of crank head 104 acting in slot 130 of drive plate 74 is on center, thereby locking carriage 10 in its position shown in FIG. 2 until crank head 104 is indexed on signal from the downstream machine. It will be seen that the actuator component, namely, the indexing mechanism 102 and the crank mechanism 168 cooperates with the guide slots 92, 94 and rollers 96, 98 of feed heads 12, 14 to positively restrain carriage 10 from movement prior to actuator operation. It will be understood that reverse conditions apply upon crank head 104 being angularly disposed 90° counter-clockwise from its midstroke position illustrated in FIGS. 8 and 9 with carriage 10 displaced upwardly as viewed in the drawings into the second punching position illustrated in FIG. 3 and with compressed air supplied to drive cylinder 52 tending to urge clamped feed head 14 forwardly.

It accordingly will be appreciated that feeder 20 is crank controlled. Crank mechanism 168 serves first as a trigger mechanism to initiate each feed stroke and then serves as a positive stop to precisely limit drive plate reciprocation and thereby feed head travel in accordance with an adjustably selected throw established by crank mechanism 168.

Figure 12:
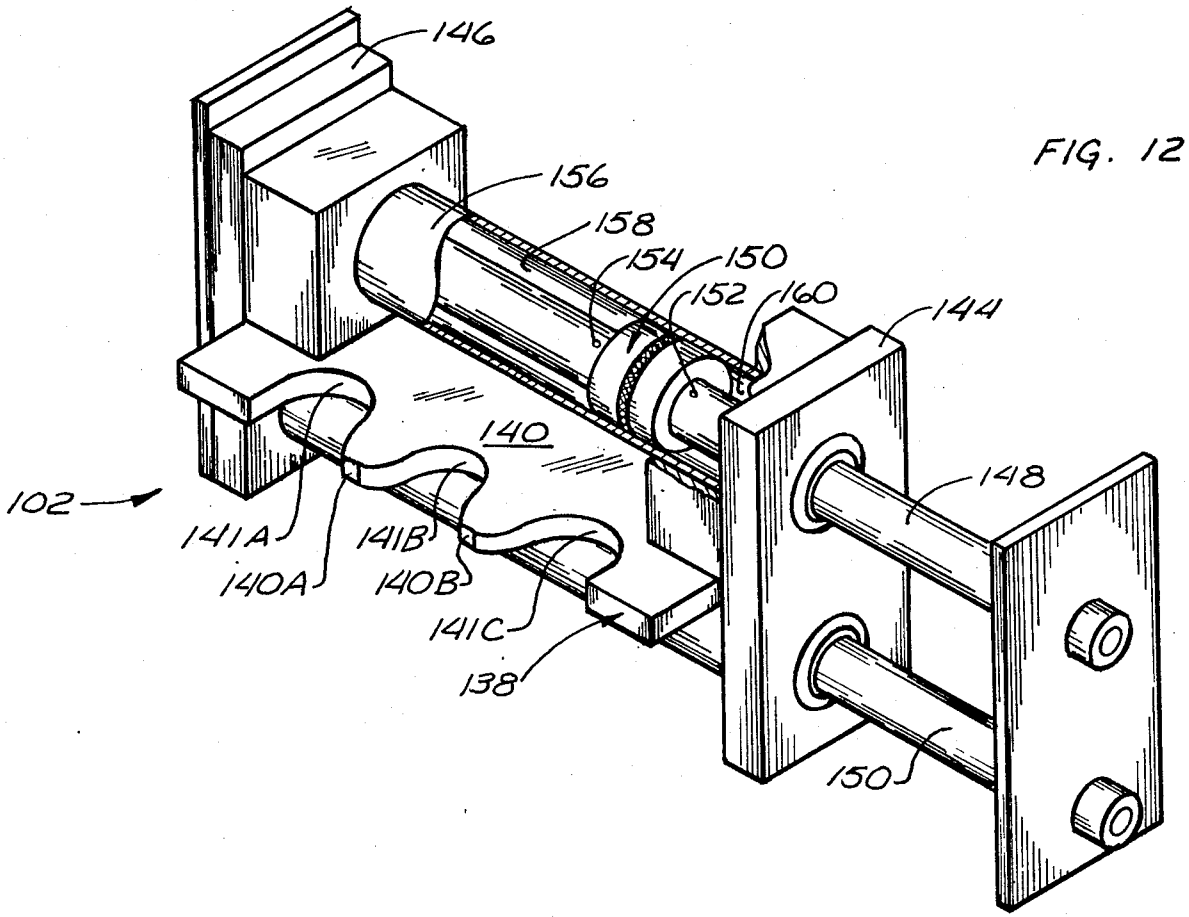
FIG. 12 is an isometric view, partly broken away and partly in section, illustrating certain components of the indexing mechanism of FIG. 10.

Indexing of crank mechanism 168 is similar to that fully described in my copending referenced U.S. patent application Ser. No. 660,143 the subject matter of which is incorporated herein by reference. Crank head 104 is mounted in fixed relation on drive shaft 108 supported for rotation in a bearing 136 which will be understood to be mounted on frame 60. In the specifically illustrated embodiment, a cam assembly 138 (FIG. 12) is shown having a single linear driver or profiled cam 140 having a pair of spaced teeth 140A, 140B defining three discrete roller engagement surfaces 141A, 141B, 141C engageable with rollers of a rotor 142 fixed to crank head shaft 108. The linear cam 140 is fixed between a pair of end blocks 144, 146 supported for reciprocating sliding movement in a straightline path on fixed hollow guide rods 148, 150 secured to opposite sides of frame 60. Suitable fluid line connections, not shown, will be understood to be connected to opposite ends of one or both of the hollow guide rods such as at 148 which has a fixed piston 150 (FIG. 12) intermediate its ends and ports 152, 154 adjacent opposite ends of piston 150. Piston 150 is received within a cylinder 156 fixed between end blocks 144, 146 in concentric relation to guide rod 148. To reciprocate cam assembly 138, pressurized air is admitted to cylinder 156 on an end of piston 150 corresponding to a desired direction of movement of cam assembly 138. A fluid line, not shown, to cylinder 156 on the opposite end of piston 150 will be understood to be open to exhaust.

Suitable pneumatic controls, not shown, also will be understood to be provided to selectively establish and reverse air connections to cylinder 156 responsive to a signal from the downstream machine. When the downstream machine starts an upstroke movement, a cam, not shown, drivingly connected to a crank shaft of the machine, for example, may be provided to operate a valve, not shown, to signal the indexing mechanism 102 and thereby exhaust air from chamber 158 of cylinder 156 on the left side of piston 150, as viewed in FIG. 12 and pressurizing cylinder chamber 160 on the right side of piston 150 to drive linear cam 140 from its illustrated position in FIGS. 12 and 13 to the right. This action causes the roller engagement surfaces 141A, 141B, 141C of the profiled cam 140 to simultaneously rotate three rollers, 162, 164, 166 of rotor 142, 180° in a clockwise direction to thereby index drive shaft 108 and its crank head 104 of crank mechanism 168 a precise 180° displacement.

As fully described in my referenced copending patent application Ser. No. 660,143, roller engagement surfaces 141A and 141C, on opposite sides of teeth 140A, 140B, are meshingly engageable with rollers 164 and 162 to define first and second index positions for the rotor 142 precisely angularly displaced 180° from one another for establishing the first and second crank throw limit positions. The third roller engagement surface 141B meshes with roller 166, and the contour of cam 140 provides continuous engagement with at least one roller, thereby minimizing lost motion between cam 140 and rotor 142.

Such action drives crank mechanism 168 to rotate its crank head 104 clockwise and triggers a movement of previously pressurized drive cylinder 52 to move the activated or clamping feed head 14 forwardly from its starting position to an advanced stroke limit position in FIG. 2, as previously described, by piston rod 16 in cooperation with the above noted clockwise throw of the associated crank mechanism 168. Simultaneously, feed head 12 converges rearwardly toward feed head 14 from its advanced stroke limit position into a retracted starting stroke limit position of feed head 12 (FIG. 2). Such idle return of feed head 12 occurs under a clamp released condition during the stock advancing movement under the influence of the power cylinder 52 driving feed head 14 with its clamping means 45 activated. The described clockwise throw of crank mechanism 168 effects a corresponding return of piston 50 within drive cylinder 54 to starting position, exhausting air from that cylinder 54. At the end of each feed stroke a signal is generated as described above, to effect sequential events in time relation to downstream machine cycling.

Upon reversing the supply and exhaust air connections to cylinder 156 to drive cam assembly 138 to the left (as viewed in FIGS. 12 and 13) to return to the position illustrated, rotor 142 is rotated precisely 180° in a counterclockwise direction. By virtue of the described linear cam 138 and cooperating rotor 142, engagement of rotor rollers 162, 164, 166 with the disclosed profiled surface of cam 140 positively limits the angular displacement of that rotor 142, and thereby the crank head 104, to a precise 180° displacement, and deceleration of the driver or cam 140 serves to decelerate rotor 142 and crank mechanism 168 as fully described in my above referenced copending U.S. patent application Ser. No. 660,143.

In view of the above described stagger feeder construction, the actual path of movement of each activated feed head 12, 14 and the effective straight-line length of each feed stroke of stock 22 are identical, in contrast to known prior art feeders. That is, the feed heads 12, 14 of this invention are guided to move a preselected distance directly in a linear path angularly oriented relative to the Y axis during each feed stroke which distance is identical in length to a given distance required between stock work station positions. Such functions are distinguished from conventional feeders wherein a feed head may be moved forwardly in parallel relation to the so-called Y axis and laterally in a separate sidewise movement perpendicular to that Y axis to obtain a desired resultant angular feed.

Such known prior art stagger feeders are conventionally modified to vary the feed of the metal stock by adjustment of the linear progression in a forward feeding direction along the Y axis and a separate adjustment of the lateral reciprocation along the X axis to obtain a desired feed stroke. Such adjustments have been sometimes empirical, and certainly troublesome and time consuming, in endeavoring to achieve precision and accuracy in a preselected feed stroke length.

A significant advantage of the disclosed direct action stagger feed of this invention is that the eccentricity of the crank head 104 (from its pivot axis 106) to establish the crank throw and effective length of the feed stroke is achieved by a single precision adjustment readily made by one of even modest skill.

As seen in FIG. 8, for example, the adjustable crank mechanism 168 controls the distance carriage 10 reciprocates parallel to the X axis as established by guide rod 64. With angular slots 92, 94 in guide plate 90 disposed at opposed angles of 60° relative to the Y axis in the specifically described embodiment, when carriage 10 moves 0.866 inch in the X axis, the rollers 96, 98 (depending from the feed heads 12, 14 and traveling in anuglar slots 92, 94) cause feed heads 12, 14 to automatically move 0.500 inch parallel to the Y axis with a resulting effective feed length of precisely 1.000 inch at an angle of 60° relative to the Y axis.

The described feeder 20 obviates any necessity whatsoever for multiple adjustments in directions parallel to the X and Y axes in changing the feeding movements. Rather, adjustment for varying blank sizes in the specifically illustrated embodiment is a simple trigometric calculation to determine the required throw of carriage 10 parallel to the X axis, responsive to a 180° movement of the indexing mechanism 102. In short, the calculation is a matter of simply multiplying the required effective feed stroke length by 0.866 and then driving the carriage 10 in the X axis by that amount.

As an example, were 1.625 inch diameter round blanks required with a web or bridge of 0.035 inch between blanks in a particular strip of metal stock to be delivered by the two row stagger feeder 20, the effective stroke length would be the sum of 1.625 inch plus 0.035 inch or a 1.660 inch travel which the activated or clamped feed head and the stock gripped thereby must move during each feed stroke. To establish the crank throw with the feed heads 12, 14 moving at an angle of 60° from the Y axis, the crank throw is the effective feed length of 1.660 inch multiplied by the sine of 60° or 0.866 (1.660 inch×0.866) or 1.438% inch. To establish that feed length stroke of 1.660 inch travel during 180° angular displacement of crank head 104, roller 128 need only be adjusted within crank head slot 132 precisely one half the crank throw of 1.438 inch or, in the example illustrated, 0.719 inch from center 106 of the crank head drive shaft 108.

It will be recognized by virtue of the direct action feed stroke provided by the disclosed stagger feeder 20 of this invention, different blank sizes are readily accommodated by merely changing the distance of travel of feed head rollers 96, 98 within angular slots 92, 94 of guide plate 90. No need whatsoever exists for making two different adjustments for separate components of movement parallel to both the X and Y axes as in known conventional feeders. Since the throw of the crank mechanism 168 is always effecting a carriage movement parallel to the X axis responsive to a 180° indexing movement of crank head 104 which oscillates to reciprocate carriage 10, adjustment of the effective feed stroke of the feed heads 12, 14 has been found to be significantly simplified by the provision of a series of stroke plates which respectively correspond to different selected feed lengths required by various blank sizes to be accommodated by the described two-row stagger feeder 20.

Figure 14:
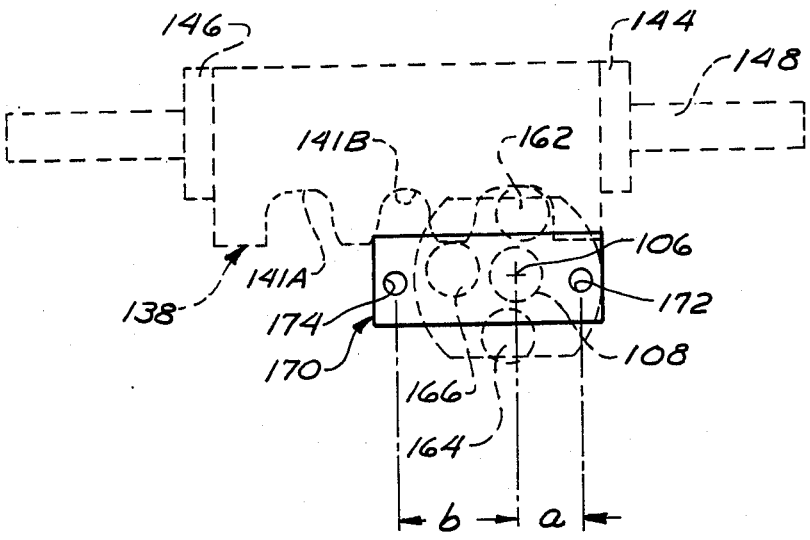
FIG. 14 is a plan view, on a reduced scale, showing a crank throw adjustment device in assembly with the associated crank and indexing mechanisms of FIG. 13.

Referring to FIGS. 13 and 14, a stroke plate 170 (FIG. 14) is provided in accordance with this invention and is illustrated having a plan view profile with peripheral bounds corresponding to the head 104 of the crank mechanism 168. Plate 170 is a thin rectangular plate having a pair of 0.250 inch diameter holes 172, 174, for example, formed in that plate. Hole 172 is shown disposed on the longitudinally extending axis of plate 170 at a distance "a" of 0.625 inch from the center 106 of the crank drive shaft 108 when fitted over locating pin 178 (FIG. 13), which itself is precisely located 0.625 inch on center from crank drive shaft 108, with the plate 170 in matching overlying relation to the crank head 104. With the plate 170 so mounted on the crank head 104, the other 0.250 inch diameter hole 174 in stroke plate 170 is displaced to the left of center 106 of shaft 108 (as viewed in FIG. 14) a distance "b" precisely corresponding to one half of the required crank throw. Hole 174 thus receives and locates the sliding bolt 134 within crank head slot 132 at a preselected distance from pivot axis 106 of crank head shaft 108 to provide the required feed stroke length, it being understood that bolt 134 is secured by a suitable nut 180 (FIGS. 7–9), in the position established by stroke plate 170. The distance "b" in FIG. 14 accordingly also equals one half stroke of carriage 10 parallel to the X axis.

In the above example, the effective length of the required feed stroke of 1.660 inch requires a crank throw of 1.438 inch or a dimension of 0.719 inch from center 106 of crank drive shaft 108. The locating pin hole 172 in stroke plate 170 is located 0.625 inch from the center of the crank drive shaft such that hole 174 is 1.344 inch from locating pin 172 hole on the longitudinal axis 176 of stroke plate 170. Accordingly, the described stroke plate 170 is made with the two openings 172, 174 precisely 1.344 inch apart from one another for a particular job which in this instance requires a feed stroke length of 1.660 inch for 1.625 inch diameter round blanks with a web or bridge of 0.035 inch stock between blanks. The locating pin hole 172 is simply fitted over locating pin 178, which is permanently fixed to project upwardly from the top of crank head 104, and the bolt 134 holding the crank head roller 128, which engages slot 130 of drive plate 74, is received in hole 174 to precisely establish the distance "b" between centers of drive shaft 108 and bolt 134. This is accomplished upon screwing the bolt 134 into nut 180 which will be understood to be trapped below slot 130 for sliding movement within crank head 104.

No trial and error or backlash considerations are experienced with the crank throw adjustment of this invention. The stroke plate 170 itself is such a simple part that it is easier to simply make a stroke plate for each particular required feed stroke length than to manually measure and fix the adjustable bolt 134 in its predetermined location in the crank head slot 132.

It will be appreciated that the described two-row direct action stagger feeder is crank actuated by suitable feed signals which trigger each feed stroke whereby the two moving feed heads 12, 14 provide a direct action feed by movement of their respective rollers 96, 98 within slots 92, 94 of guide plate 90 at a preselected angle to the feed line. Once the activated feed head has moved stock 22 into a punching position, the opposite feed head drive cylinder is immediately pressurized in preparation for the next feed stroke. Such "load and fire" pre-pressurizing of drive cylinders 52, 54 automatically insures proper synchronized movement of feeder 20 during each subsequent stroke. There is no requirement for discrete mechanical buffers or stop devices. Rather, undesired lost motion in the crank mechanism 168 is taken up during the power stroke of the drive cylinder piston without affecting the length of the feed stroke. This feed head motion is fully crank controlled, and indexing of the crank mechanism 168 is synchronized with operation of the downstream machine which upon taking place triggers each stroke, the length of which is controlled by the throw of the crank which is readily adjustable. Changes in the feed stroke or actual length of travel of the feed head rollers 96, 98 in guide plate slots 92, 94 is provided by a simple crank throw adjustment. This adjustment is even further simplified by the provision of the disclosed stroke plate 170.

While the construction of feeder 20 has been described in relation to the illustrated components, obvious alternatives to the specifically described embodiment are contemplated. For example, the cam and cam follower connection which serves as a motion control means between the feed heads 12, 14 and frame 60 could be provided by a reversal of parts. Moreover, other arrangements are contemplated wherein fixed guide means is provided on the frame with the feed heads mounted thereon for following movement along the path defined by the guide means.

As will be apparent to persons skilled in the art, various modifications, adaptations and variations of the foregoing specific disclosure can be made without departing from the teachings of this invention.

I claim:

1. A feeder for advancing stock in intermittent feed strokes into a downstream work station of a machine such as power press and the like and comprising a frame, a power operated feed head for advancing stock during a feed stroke, a carriage supporting and constraining the feed head for movement parallel to a first axis extending in the feeding direction, the frame supporting and constraining the carriage for movement parallel to a second axis perpendicular to said first axis, a crank mechanism, and an indexing mechanism for indexing the crank mechanism for controlling feed head movement.

2. The feeder of claim 1 wherein the indexing mechanism simultaneously releases the carriage for movement and triggers actuation of the power operated feed head and stock to be advanced thereby for direct linear movement along said angularly disposed stock advancing path.

3. The feeder of claim 1 further including a first guide means mounted on the carriage in parallel relation to said first axis and supporting the feed head for linear reciprocable movement, and a second guide means mounted on the frame in parallel relation to said second axis and supporting the carriage for linear reciprocable movement.

4. The feeder of claim 1 wherein feed head movement along said angularly disposed stock advancing path is coincident with stock feeding movement and defines a feed stroke identical in length to a given distance required between stock work station positions.

5. A feeder for advancing stock in intermittent feed strokes into a downstream work station of a machine such as a power press and the like and comprising a frame, a plate fixed to the frame, a power operated feed head for advancing stock during a feed stroke, a carriage supporting and constraining the feed head for movement parallel to a first axis extending in the feeding direction, the frame supporting and constraining the carriage for movement parallel to a second axis perpendicular to said first axis, and motion control means interconnecting the feed head and frame defining a linear stock advancing path for the feed head disposed at a predetermined angle relative to said first axis, the motion control means including a linear guide slot formed in the plate at said determined angle relative to said first axis, and a follower mounted on the feed head and received in the guide slot of the plate.

6. A feeder for advancing stock in intermittent feed strokes into a downstream work station of a machine such as a power press and the like and comprising a frame, a power operated feed head for advancing stock during a feed stroke, a carriage supporting and constraining the feed head for movement parallel to a first axis extending in the feeding direction, the frame supporting and constraining the carriage for movement parallel to a second axis perpendicular to said first axis, and motion control means interconnecting the feed head and frame defining a linear stock advancing path for the feed head disposed at a predetermined angle relative to said first axis, the motion control means including an actuator for simultaneously releasing the carriage for movement and triggering actuation of the power operated feed head and stock to be advanced thereby for direct linear movement along said angularly disposed stock advancing path, and a fluid operated, single acting power cylinder cooperating with the actuator for driving the feed head from a starting position to an advanced stroke limit position along said angularly disposed stock advancing path, the power cylinder being pre-pressurized when the feed heat is in its starting position for driving the feed head into its advanced stroke limit position responsive to operation of the actuator.

7. A feeder for advancing stock in intermittent feed strokes into a downstream work station of a machine such as a power press and the like and comprising a frame, a power operated feed head for advancing stock during a feed stroke, a carriage supporting and constraining the feed head for movement parallel to a first axis extending in the feeding direction, the frame supporting and constraining the carriage for movement parallel to a second axis perpendicular to said first axis, and motion control means interconnecting the feed head and frame defining a linear stock advancing path for the feed head disposed at a predetermined angle relative to said first axis, the motion control means including an actuator for simultaneously releasing the carriage for movement and triggering actuation of the power operated feed head and stock to be advanced thereby for direct linear movement along said angularly disposed stock advancing path, the actuator further including a crank mechanism and an indexing mechanism for the crank mechanism, the crank mechanism being movable, responsive to actuation of the indexing mechanism, through a 180° angular displacement in a selected angular direction to release the carriage for movement parallel to said second axis between first and second preselected carriage positions in synchronism with movement of the feed head between starting and advanced stroke limit positions along said angularly disposed stock advancing part.

8. The feeder of claim 7 further including adjustment means for the crank mechanism providing an adjustable throw for selectively establishing the effective length of the stock feed stroke provided by the feed head.

9. The feeder of claim 7 further including a power cylinder cooperating with the crank mechanism to drive the feed head precisely into its advanced stroke limit position as defined by the throw of the crank mechanism through said 180° angular displacement.

10. The feeder of claim 7 including a fluid operated, single acting power cylinder drivingly connected to the feed head, the power cylinder being pre-pressurized when the feed head is in its starting position, and wherein movement of the crank mechanism serves to trigger movement of the feed head under the driving force of its power cylinder from said starting position of the feed head to its advanced stroke limit position.

11. A feeder for advancing stock in intermittent feed strokes into a downstream work station of a machine such as a power press and the like and comprising a frame, a power operated feed head for advancing stock during a feed stroke, a carriage supporting and constraining the feed head for movement parallel to a first axis extending in the feeding direction, the frame supporting and constraining the carriage for movement parallel to a second axis perpendicular to said first axis, and motion control means interconnecting the feed head and frame defining a linear stock advancing path for the feed head disposed at a predetermined angle relative to said first axis, the motion control menas including a crank mechanism having a throw movable through a 180° angular displacement to release the carriage for movement parallel to said second axis between first and second carriage positions in synchronism with feed head movement between starting and advanced stroke limit positions along said angular disposed stock advancing path.

12. The feeder of claim 11 wherein the crank mechanism includes throw adjustment means serving to adjust the effective length of the stock feed stroke provided by the feed head.

13. The feeder of claim 11 wherein the crank mechanism includes a crank head mounted in fixed relation to a rotatable drive shaft supported for rotary movement on the frame, and wherein a stroke adjustment plate is mounted on the crank head in overlying relation thereto for establishing a preselected throw of the crank mechanism.

14. The feeder of claim 11 wherein the carriage includes a slot extending parallel to said first axis, wherein the crank mechanism includes a crank head mounted in fixed relation to a rotatable drive shaft supported for rotary movement on the frame, the crank head having a slot and a locating pin fixed to the head in eccentric relation to the drive shaft, a fastener received in the crank head slot and in the carriage slot for establishing a drive connection therebetween, and a stroke plate having first and second openings therein, said first opening of the stroke plate being registrable with the locating pin of the crank head, said second opening of the stroke plate being disposed a predetermined distance from the axis of rotation of the crank head drive shaft and registrable with the crank head slot such that upon securing the fastener within the second opening of the stroke plate to drivingly interconnect the crank mechanism and carriage, movements of the carriage are established by a preselected throw of the crank mechanism corresponding to the predetermined spacing between the axis of rotation of the crank head drive shaft and said second opening of the stroke adjustment plate.

15. The feeder of claim 14 wherein said second opening of the stroke plate is eccentrically offset from the axis of rotation of the crank head drive shaft a preselected distance equal to both one half the crank throw and one half the carriage travel, to thereby effect a desired length feed stroke.

16. A feeder for advancing stock in intermittent feed strokes into a downstream work station of a machine such as a power press and the like and comprising a frame, a feed head for advancing stock during a feed stroke, a powered operator for the feed head, a carriage supporting and constraining the feed head for movement parallel to a first axis extending in the feeding direction, the frame supporting and constraining the carriage for movement parallel to a second axis perpendicular to said first axis, and motion control means interconnecting the feed head and frame defining a linear stock advancing path for the feed head disposed at a predetermined angle relative to said first axis, the motion control means including a crank mechanism mounted on the frame and drivingly connected to the carriage, the crank mechanism movable through a predetermined angular displacement defining first and second crank throw limit positions terminating carriage movement in opposite linear directions respectively corresponding to starting and advanced feed head stroke limit positions, and an indexing mechanism for controlling operation of the crank mechanism, the indexing mechanism including a driver mounted for linear reciprocating movement on the frame, and a driven rotor supported for rotation on the frame about a fixed axis and drivingly connected between the driver and the crank mechanism, and a driving connection between the driver and rotor.

17. The feeder of claim 16 wherein the driver includes a profiled cam having roller engagement surfaces, and wherein the driven rotor includes a plurality of rollers engageable with said roller engagement surfaces of the cam for rotating the rotor in opposite angular directions in the following response to reciprocating linear movements of the driver.

18. The feeder of claim 16 wherein the driver includes a profiled cam having a pair of spaced teeth defining three discrete roller engagement surfaces, and wherein three rollers are mounted on the rotor for engagement with the three roller engagement surfaces respectively.

19. The feeder of claim 18 wherein the roller engagement surfaces include first and second surfaces on opposite sides of said pair of spaced teeth for meshing engagement with first and second rollers to define first and second index positions for the rotor precisely angularly displaced 180° from one another for establishing said first and second crank throw limit positions, and wherein a third roller engagement surface is defined between said pair of spaced teeth for meshing engagement with a third roller.

20. The feeder of claim 19 wherein the roller engagement surfaces are dimensioned and contoured for continuous engagement with a least one roller regardless of the relative positions of the driver and rotor, thereby to minimize lost motion between the cam and rotor.

21. The feeder of claim 16 wherein the powered operator further includes a fluid operated power cylinder drivingly connected to the feed head and cooperating with the crank mechanism to drive the feed head from its starting position precisely into its advanced stroke limit position responsive to carriage movement in one linear direction as defined by the throw of the crank mechanism in one angular direction.

22. The feeder of claim 21 wherein the power cylinder is single acting and serves to take up lost motion of the crank mechanism in a stock advancing direction, the power cylinder being deactivated during an idle return movement of the feed head from advanced stroke limit position to its starting position.

23. A feeder for advancing stock in intermittent feed strokes into a downstream work station of a machine such as a power press and the like and comprising a frame, a pair of power operated, alternately acting feed heads, a carriage including common guide rods mounted thereon, the carriage supporting the feed heads for reciprocating sliding movement on said common guide rods, the common guide rods being mounted for reciprocable sliding movement on the carriage parallel to a first axis extending in a feeding direction, the frame supporting the carriage for reciprocable sliding movement parallel to a second axis extending perpendicular to said first axis, and motion control means drivingly interconnecting each of the feed heads and frame, the motion control means defining a linear stock advancing path for each feed head, the linear stock advancing paths of the feed heads being disposed respectively at opposed angles relative to said first axis.

24. The feeder of claim 23 including an actuator for releasing the carriage for movement and simultaneously triggering actuation of a selected power operated feed head and stock to be advanced thereby for direct linear movement along its said angularly disposed stock advancing path.

25. The feeder of claim 23 wherein the actuator and motion control means jointly cooperate to positively restrain the carriage from movement prior to operation of the actuator.

26. The feeder of claim 24 wherein the actuator further includes a crank mechanism and an indexing mechanism for the crank mechanism, the crank mechanism being movable, responsive to actuation of the indexing mechanism, through a 180° angular displacement in opposite angular directions to release the carriage for movement in a selected linear direction parallel to said second axis between first and second preselected carriage positions in synchronism with opposed movements of the feed heads between starting and advanced stroke limit positions along said angularly disposed stock advancing paths.

27. The feeder of claim 26 wherein the crank mechanism further includes adjustment means for selectively establishing the linear carriage displacement between its first and second carriage positions and therefor the effective lengths of the stock feed stroke provided by each of the feed heads.

28. The feeder of claim 26 including a fluid operated, single acting power cylinder drivingly connected to each feed head, the power cylinder of each feed head being pre-pressurized when that feed head is in its starting position, and wherein subsequent movements of the crank mechanism serve to alternately trigger movement of each feed head under the driving force of its respective power cylinder from said starting position of the feed head to its advanced stroke limit position.

29. The feeder of claim 23 wherein movement of each feed head along its respective angularly disposed stock advancing path is coincident with stock feeding movements and defines a feed stroke identical in length to a given distance required between stock work station positions.

30. The feeder of claim 26 further including adjustment means providing a single adjustment of the throw of the crank mechanism to adjust the effective length of the stock feed stroke provided by each feed head.

* * * * *

UNITED STATES PATENT AND TRADEMARK OFFICE

CERTIFICATE OF CORRECTION

PATENT NO. : 4,610,380

DATED : September 9, 1986

INVENTOR(S) : Edwin W. Plumb

It is certified that error appears in the above—identified patent and that said Letters Patent is hereby corrected as shown below:

Column 1, line 44 wherein the word "resulting" should be --resultant--.

Column 8, line 67 wherein the number "1.438% inch" should be --1.438 inch--.

Column 12, line 22 wherein the words "advancing part" should be --advancing path--.

Column 13, line 46 wherein the words "mechanism movable" should be --mechanism being movable--.

Signed and Sealed this

Thirtieth Day of December, 1986

*Attest:*

DONALD J. QUIGG

*Attesting Officer*

*Commissioner of Patents and Trademarks*